United States Patent [19]

Bania

[11] Patent Number: 4,678,506

[45] Date of Patent: Jul. 7, 1987

[54] PRODUCTION OF TITANIUM ARTICLES THAT ARE FREE FROM LOW DENSITY INCLUSIONS

[75] Inventor: Paul J. Bania, Boulder City, Nev.

[73] Assignee: Titanium Metals Corporation of America (TIMET), Pittsburgh, Pa.

[21] Appl. No.: 895,446

[22] Filed: Aug. 11, 1986

[51] Int. Cl.[4] ..... C22B 4/00

[52] U.S. Cl. ..... 75/10.25; 75/10.26; 75/84; 75/256

[58] Field of Search ..... 75/10.25, 10.26, 256, 75/84

[56] References Cited

U.S. PATENT DOCUMENTS 2,974,033 3/1961 Krieger ..... 75/10.26

3,024,102 3/1962 Brown ..... 75/10.26

*Primary Examiner*—Peter D. Rosenberg

*Attorney, Agent, or Firm*—Finnegan, Henderson, Farabow, Garrett & Dunner

[57] ABSTRACT

The production of titanium articles that are free from low-density inclusions by the use of titanium sponge particles for melting which particles have substantially a maximum particle size of −6 mesh and finer, preferably −8 mesh and finer.

4 Claims, No Drawings

PRODUCTION OF TITANIUM ARTICLES THAT ARE FREE FROM LOW DENSITY INCLUSIONS

BACKGROUND OF THE INVENTION

Titanium is extracted from ore by the production of titanium tetrachloride and its subsequent reduction to titanium by reaction with either magnesium or sodium. Electrolytic reduction may also be used. The reduction product is a porous, spongy material, which is referred to as titanium sponge. Titanium sponge is typically converted to titanium alloy products, including mill products, by a series of consumable electrode melting operations. Initially, the titanium sponge with either alloy particles mixed therewith or unalloyed in particle form is typically pressed to compact the particles to form compacts or brickettes that are joined as by welding to produce an electrode. Alloying elements may be introduced in admixture with the sponge particles in desired amounts for producing titanium-base alloys. The electrode is vacuum arc melted to produce an ingot which typically is then re-melted once or twice to produce a final ingot. The ingot resulting from either double or triple vacuum arc melting is then typically processed by a series of forging and annealing steps to form from the ingot products such as a billet or shaped products that are machined to desired final product configurations.

During the production of titanium sponge typically reaction with the ambient atmosphere may cause a reaction of particles of the titanium sponge with air to form nitride or oxynitride particles, which ultimately can result in defects known as low density inclusions in the ingot and products made therefrom. These nitrogen-rich particles are highly refractory and thus do not melt during the conventional vacuum arc melting steps incident to the production of a titanium ingot. Typically, the nitride or oxynitride particles slowly dissolve during the vacuum arc melting operation. As the particles dissolve slowly, they tend to sink to the bottom of the molten metal pool formed during vacuum arc melting. If not completely dissolved when they sink to the bottom of the pool the titanium solidifies above these undissolved particles to entrap them in solid titanium. This retards dissolving of the particles, because the dissolution of the particles is by a solid state reaction process. Consequently, these particles result in defects in the form of highly refractory, hard, porous particles which are contained within the solidified ingot. These defects are known as low density inclusions. They are termed "low density" inclusions because of their apparent low density when detected by conventional X-ray inspection. During this inspection, their porous nature allows greater X-ray penetration than the remainder of the product so that they appear as a lower density material. In contrast, inclusions of refractory metals, such as tungsten and molybdenum, allow less X-ray penetration and consequently are termed high density inclusions.

During subsequent reduction of the titanium ingot as by forging and/or rolling to the desired shapes, such as billet, bar and plate, the low-density inclusions remain within these products. For this reason, the products are conventionally subjected to ultrasonic and/or X-ray inspection for detection of low-density inclusions, and low-density inclusions so detected are removed by removing the sections of the product containing them. Inevitably, however, some low-density inclusions go undetected and may find their way into final products.

Low-density inclusions in final products provide sites for crack initiation, particularly when the products are subjected to stress during service, to result in failure of these final products.

OBJECTS OF THE INVENTION

It is accordingly a primary object of the present invention to provide titanium sponge and a method for producing titanium products therefrom, as by vacuum arc melting, wherein the presence of low-density inclusions is substantially eliminated from the product.

A more particular object of the invention is to provide titanium sponge for melting to produce titanium products wherein any particles that may result in low-density inclusions contained in the titanium sponge will be completely dissolved during conventional melting incident to the production of titanium articles.

SUMMARY OF THE INVENTION

Conventionally, charges of titanium sponge particles for use in melting to produce ingots contain particles as large as 5/16 in. or greater. Particles of this size would not pass through a 6 mesh U.S. standard or finer screen. In contrast, in accordance with the invention a particle charge of titanium sponge adapted for melting to produce titanium articles, as for use in forming an electrode for conventional vacuum arc melting, is provided wherein the titanium sponge charge has substantially a maximum titanium sponge particle size of −6 mesh and finer, U.S. Standard. Preferably, the maximum titanium sponge particle size is −8 mesh and finer. The titanium sponge charge of this particle size is melted as by forming the charge into a consumable electrode adapted for vacuum arc melting in the conventional manner. In accordance with the method of the invention, the charge of titanium sponge of a substantially maximum particle size of −6 mesh and finer, preferably −8 mesh and finer, is formed into a consumable electrode and the electrode is vaccum arc melted to form an ingot. The ingot is typically re-melted once or twice by vacuum arc melting.

The particles may be formed into the electrode by pressing, with or without alloying additions, to form pressed metal compacts or brickettes which are then joined, as by inert gas welding, to produce a consumable electrode of the desired size and configuration for initial vacuum arc melting.

By the use of these finer than conventional sponge particle sizes, any particles that are nitrogen-rich to constitute potential low-density inclusions will be of a size sufficiently small to enable them to dissolve during melting and specifically vacuum arc melting of a consumable electrode containing these particles.

DESCRIPTION OF THE PREFERRED EMBODIMENTS AND EXAMPLES

To demonstrate the invention, titanium sponge was screened to form the following size fractions:

−5/16″+6 mesh, U.S. Standard
−6 mesh+8 mesh, U.S. Standard
−8 mesh+10 mesh, U.S. Standard The sponge particles of the above three size fractions were subjected to a nitrogen/argon atmosphere at a temperature of 1200 C. for 6 hours. This resulted in nitriding of the particles to a nitrogen content within the range of 14 to 16 wt. % nitrogen. These nitrided particles (referred to as "seeds") simulate and typify low-density inclusion forming particles that may be characterized as being the most difficult to dissolve during conventional vaccum arc melting operations incident to the production of titanium ingots. Although in practice, lower nitrogen content particles can result in the formation of low density inclusions, particles within this nirogen range constitute the worst-case situation based on analysis of low density inclusions in actual commercial operations. For a given particle size, the higher the nitrogen content the longer it will take to dissolve. The −5/16" size particles represent the coarsest size particles typically encountered as low-density inclusions in titanium sponge. Consequently, these would represent conventional material for the production of electrodes for vaccum arc melting with the remaining two size fractions being of smaller particle size than conventionally used for this purpose.

EXAMPLE I

An initial experiment was conducted wherein 200 of the nitrided seeds, as described above, were blended with 15 pounds of sponge screened to a corresponding size fraction to result in three particle charges. Each of the three charges were compacted to form an electrode and vacuum arc melted in accordance with conventional practice. Specifically, three successive melting steps (primary double and triple melt) were employed. After each melting step, each ingot was sectioned in an identical manner and examined for low density inclusions (LDI). Specifically, each section of each ingot was machined and thereafter visually examined for low density inclusions. After each examination, the sections were welded to form an electrode which was remelted. The results are summarized in Table I.

TABLE I

| Heat | Sponge Size | Seed Size | # of Seeds (1) | LDIs found after each melt step: Primary | Double | Triple |
|---|---|---|---|---|---|---|
| | | 15-Lb Heats | | | | |
| V6348 | −5/16" and finer | −5/16" +6 | 200 | 24 | 29 | 5 |
| V6389 | −6 Mesh and finer | −6 +8 | 200 | 5 | 1 | 0 |
| V6384 | −8 Mesh and finer | −8 +10 | 200 | 4 | 0 | 0 |

(1) Titanium sponge particles of the appropriate size fraction with 14%–18% nitrogen.

EXAMPLE II

The invention was demonstrated on a larger scale by producing ingots from the three prepared size fractions to produce a total of six 330 pound heats of an 11" diameter, three of which were subjected to double melting and three of which were triple melted. Equal portions of sponge and the prepared, nitrided seeds were used in the construction of the electrodes. The results of the examination of these heats are set forth on Table II.

TABLE II

| Heat | Sponge Size | Seed Size | # of Seeds (1) | No. of Defects Detected | Avg. LDI Size (2) | % LDI's Survived |
|---|---|---|---|---|---|---|
| | | 330-Lb Heats (Double Melted) | | | | |
| V6400 | −5/16" and finer | −5/16" +6 | 200 | 10 | 163% | 5% |
| V6402 | −6 Mesh and finer | −6 +8 | 2500 | 10 | 185% | 4% |
| V6401 | −8 Mesh and finer | −8 +10 | 7200 | 12 | 130% | .7% |
| | | 330-Lb Heats (Triple Melted) | | | | |
| V6445 | −5/16" and finer | −5/16" +6 | 200 | 9 | 167% | 4.5% |
| V6443 | −6 Mesh and finer | −6 +8 | 2500 | 2 | 75% | 08% |
| V6444 | −8 Mesh and finer | −8 +10 | 7200 | 3 | 63% | 04% |

(1) Titanium sponge particles of the appropriate size fraction with 14–18% nitrogen.
(2) Stated as 7% of a #2 flat bottom hole (FBH).

It should be noted that the low-density inclusions were detected by ultrasonic inspection after the ingots had been forged to a 4" diameter bar in accordance with standard bar production practice.

It may be seen from Table II that the low-density inclusions were significantly reduced in accordance with the practice of the invention as was the case with the Example I experiment. By the use of the fine titanium sponge the corresponding sizes of any low-density inclusion forming particles are such as to permit substantially complete dissolving thereof by conventional vacuum arc melting practice.

With the invention, therefore, by the use of finer than conventional sponge particle sizes, any low-density inclusion forming particles will be dissolved during conventional melting practice. Consequently, by maintaining all of the sponge particles within the size limits of the invention all of the particles that are potential formers of low-density inclusions upon melting will dissolve. The titanium sponge particle size in accordance with the invention may be obtained by screening to the desired size fraction. Alternatively, the particles may be reduced in size as by crushing, shearing and chopping and thereafter screened to achieve the desired size fraction.

The term "titanium" as used herein and in the claims is intended to include titanium alloys.

What is claimed is:

1. A method for producing arc melted titanium articles substantially free of low-density inclusions, said method comprising producing a partial charge of titanium sponge of a maximum particle size of −6 mesh and finer, forming said particles into an electrode and arc melting said electrode to form an ingot.

2. The method of claim 1 wherein said ingot is remelted by arc melting.

3. The method of claim 1 or 2 wherein said titanium sponge is of a maximum particle size of −8 mesh and finer.

4. The method of claim 1 wherein said electrode is vacuum arc melted.

* * * * *